United States Patent [19]

MacManus

[11] 4,249,056

[45] Feb. 3, 1981

[54] SEQUENTIAL SWITCHING DEVICE

[75] Inventor: Daniel C. MacManus, Owosso, Mich.

[73] Assignee: General Motors Corporation, Detroit, Mich.

[21] Appl. No.: 11,205

[22] Filed: Feb. 12, 1979

[51] Int. Cl.[3] ..... H01H 9/00

[52] U.S. Cl. ..... 200/1 B; 200/5 R; 200/17 R; 200/292

[58] Field of Search ..... 200/11 R, 5 R, 4, 1 R, 200/11 D, 11 DA, 11 K, 155 R, 155 A, 275, 283, 292, 243, 159 R, 159 A, 159 B, 164 R, 164 A, 165, 340, 276, 1 B, 17 R; 338/202, 171, 49; 73/146.5; 340/670

[56] References Cited

U.S. PATENT DOCUMENTS 3,523,450 8/1970 Openshaw et al. ..... 73/146.5

FOREIGN PATENT DOCUMENTS 917590 2/1963 United Kingdom ..... 200/11 R

*Primary Examiner*—Gene Z. Rubinson
*Assistant Examiner*—Morris Ginsburg
*Attorney, Agent, or Firm*—Warren D. Hill

[57] ABSTRACT

A mechanical switch having a plurality of sequentially energized outputs responsive to the displacement of a push button or other linear actuator comprises an arcuate array of fixed contacts on a rigid printed circuit board and a single movable contact comprising a helical spring member with its axis normal to the circuit board and having one end contacting one of the fixed contacts. The spring rate of the spring progressively varies along its length such that when the spring is compressed by an axially applied force the spring sequentially and progressively contacts and bridges the fixed contacts thereby sequentially engaging the fixed contacts.

4 Claims, 4 Drawing Figures

SEQUENTIAL SWITCHING DEVICE

This invention relates to a switching device of the type which progressively and serially energizes a plurality of switch terminals.

It is desirable to provide a switching device to sequentially and progressively energize a plurality of switch terminals in response to displacement of a mechanical actuator. Such a switch is useful, for example, in energizing the light segments of an analog light display such as for a vehicle speedometer with a line of light made up of individual lamps representing a value such as a certain speed. Heretofore, solid state logic circuitry has been employed in conjunction with a speed transducer to energize such a display.

It is, therefore, a general object of this invention to provide a mechanical sequential switch for energizing sequentially a plurality of switch terminals in response to mechanical switch actuation and particularly such a switch wherein each terminal when energized remains energized as the succeeding higher order terminals are energized during a progressive movement of the switch actuator.

It is a further object to provide such a sequential switch wherein a simple compact structure having a minimum of moving parts and inexpensive manufacture is required.

The invention is carried out by providing an arcuate array of fixed contacts on a rigid insulating substrate and a movable contact in a form of a helical spring for bridging the contacts when the spring is axially compressed. The spring has a variable spring rate so that the fixed contacts are progressively and sequentially engaged by the helical spring during its compression.

The above and other advantages will be made more apparent from the following specification taken in conjunction with the accompanying drawings wherein like reference numerals refer to like parts and wherein.

Figure 1:
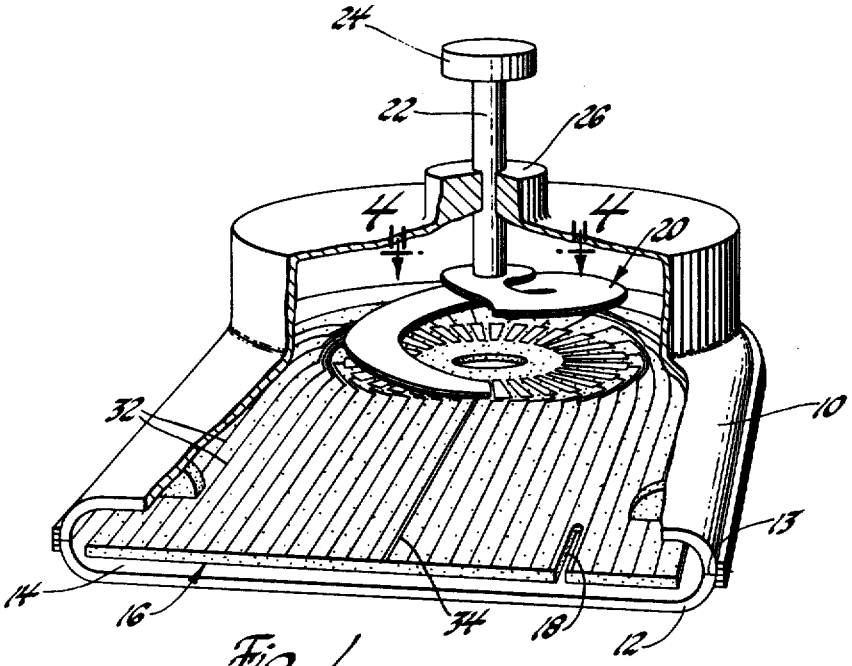
FIG. 1 is a partly broken away perspective view of a sequential switch according to the invention.

Referring to FIG. 1 a switch housing comprises upper and lower sections 10 and 12 respectively meeting at a parting plane 13. The housing defines an enclosed chamber which opens into a mouth portion 14 for accommodating a plug-in connector, not shown. A printed circuit board 16 in the housing has a front portion extending into the opening 14 to provide a male connector portion with a key slot 18. In the opposite end of the housing, the upper portion 10 defines a cylindrical cavity which accommodates a helical contact spring 20 with its longitudinal axis aligned perpendicular to the circuit board 16. An actuator rod 22 provided with a push button 24 extends through an apertured boss 26 in the housing portion 10 and engages the top of helical contact spring 20.

Figure 2:
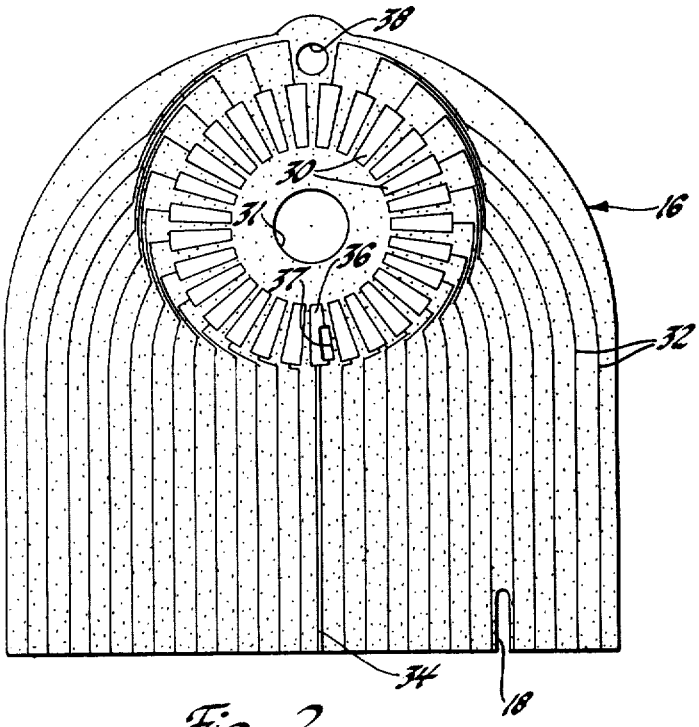
FIG. 2 is a plan view of a printed circuit board comprising the fixed contacts of the switch according to the invention.

As best shown in FIG. 2, the circuit board 16 comprises a rigid insulating support with conductive paths formed thereon with the conductors preferably in the form of a conductive plastic. An arcuate array of conductive fixed contacts 30 are arranged around an aperture 31 at one end of the circuit board 16. Each fixed contact is connected to the terminal portion of the board by a conductive path 32 which together comprise the conductive terminal portions at the edge of the board 16. While the drawings depict the conductive paths 32 as fine lines, they may, of course, have substantial width as dictated by design considerations. One pathway 34 of larger current carrying capacity than the others is provided to carry the input power to the switch and leads to a primary fixed contact 36. A slot 37 is provided in the board adjacent the contact 36 to facilitate mounting the contact spring 20 to the circuit board. An apertured ear 38 on the circuit board provides a convenient device for fastening to the housing.

Figure 3:
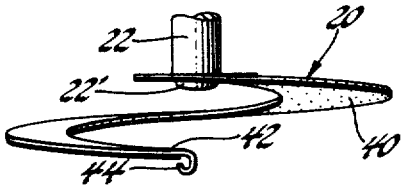
FIGS. 3 and 4 are side and plan views respectively of the movable contact of the switch of FIG. 1.
Figure 4:
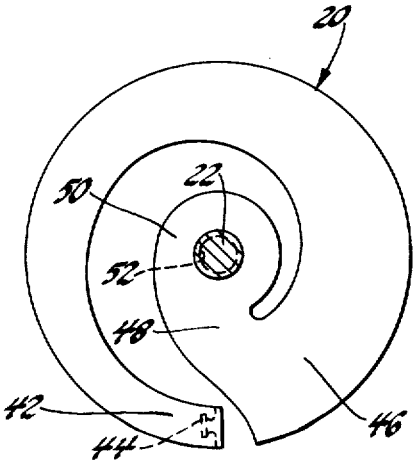

As shown in FIGS. 3 and 4, the helical contact spring 20 is formed from a flat sheet stock such as a beryllium copper and has on the underside, that is, the side which contacts the fixed contacts 30, a layer 40 of conductive elastomer bonded to the surface of a spring. The conductive elastomer comprises, for example, a silicone rubber impregnated with silver coated glass spheres. The end 42 of the spring 20 which engages the circuit board 16 terminates in a bent over tang 44 which pierces through the slot 37 and clamps the circuit board to hold the end of the spring 20 in secure electrical engagement with the primary fixed contact 36. The end 42 of the spring contact is narrow and the spring contact gradually becomes wider toward the other end 46 so as to provide a variable spring rate. This allows the spring to progressively engage the surface of the circuit board 16 when the spring is compressed in order to sequentially bridge the fixed contacts 30. The wide end 46 of the spring is connected by a neck 48 to a center portion 50 containing an aperture 52 to facilitate mounting the spring center portion 50 to the actuator rod 22. As shown in FIG. 3, the extreme end 22' of the actuator rod 22 extending through the aperture 52 is upset to retain the spring contact 20.

In operation the switching device is connected to a wiring harness which supplies to the lead 34 a supply voltage and receives from the leads 32 output voltages when they are present. In the normal state, shown in FIG. 1, where the spring contact 20 is in its fully extended position, none of the leads 32 are energized. However, when the actuator 22 is depressed, the spring contact 20 is compressed and the narrow end 42 of the spring engages the fixed contacts 30 nearest the conductor 36 and as the actuator 22 is further depressed, the spring contact 20 progressively engages the board 16 to sequentially bridge the contacts 30, thereby serially energizing the conductors 32 with the voltage present on the conductor 34 so that the number of conductors energized is dependent on the degree of depression of the actuator 22. Each conductor 32 when energized remains in that state until the actuator 22 is retracted to thereby sequentially open the series of switches formed by the contacts 30 and the spring contact 20. The conductive elastomer 40 upon the surface of the spring contact 20 serves to provide a light scrubbing action against the fixed contacts 30 during actuation of the spring contact 20 to provide a contact cleansing function.

Many applications of the switching device according to the invention will be apparent. For example, the actuator 22 may be operated manually or in the case of a speedometer application may be actuated by a flyball mechanism driven by a rotating shaft so that the number of conductors 32 which are energized will be a function of shaft speed. The conductors are each connected to one of a linear series of lamps to effect a line of light representing speed. The actuator 22 instead of extending through the top housing part 10 may instead extend through a similar aperture in the lower housing part 12 and through the aperture in the circuit board to engage the locating hole 52 in the top of the spring contact 20. It is evident that while a conductive plastic printed circuit board is preferred other types of circuit boards such as those formed by a conventional photoetch process are also suitable. It is further evident that the switch structure which contains very few parts is easily and inexpensively manufactured and can be very compact.

The embodiments of the invention in which an exclusive property or privilege is claimed are defined as follows:

1. A sequential switching device for progressively and serially operating a plurality of switches having a common movable contact, comprising a rigid insulating support, a plurality of fixed contacts arcuately arranged in a plane on the support and mounted thereon, a movable contact comprising a helical spring member mounted with its axis perpendicular to the plane of the fixed contacts, one end of the spring member being secured to the support, the spring member normally being in engagement with one of the fixed contacts and by compression axially movable into progressive electrical engagement with the other fixed contacts to bridge the fixed contacts, the number of said fixed contacts engaged by the movable contact depending on the degree of compression of the helical spring member, and means for applying a force to the helical spring member to compress it into engagement with the fixed contacts.

2. A sequential switching device for progressively and serially operating a plurality of switches having a common movable contact, comprising a planar rigid insulating support, a circular array of fixed contacts mounted on the support, and a terminal lead connected to each fixed contact, a movable contact comprising a helical spring member mounted with its axis perpendicular to the plane of the support, one end of the spring member being secured to the support in electrical engagement with one of the fixed contacts, the spring member having a low spring rate at the said one end and progressively increasing in spring rate toward the other end whereby upon axial compression the spring member is progressively movable into electrical engagement with the other fixed contacts to bridge the contacts, the number of fixed contacts engaged by the movable contact depending on the degree of compression of the spring member, and an actuator secured to the other end of the spring member for support thereof and for applying a force to the spring member to compress it into engagement with the fixed contacts.

3. A sequential switching device for progressively and serially operating a plurality of switches having a common movable contact, comprising a planar rigid insulating support, a circular array of fixed contacts mounted on the support, and a terminal lead connected to each fixed contact, a movable contact comprising a helical spring member mounted with its axis perpendicular to the plane of the support, one end of the spring member being secured to the support in electrical engagement with one of the fixed contacts, the spring member being formed of flat metal stock coated on the side which engages the fixed contacts with a conductive elastomer and being narrow at the one end and gradually increasing in width toward the other end to provide a progressively varying spring rate whereby upon axial compression the spring member is progressively movable into electrical engagement with the other fixed contacts to bridge the contacts, the number of fixed contacts engaged by the movable contact depending on the degree of compression of the spring member, and an actuator secured to the other end of the spring member for support thereof and for applying a force to the spring member to compress it into engagement with the fixed contacts.

4. A sequential switching device for progressively and serially operating a plurality of switches having a common movable contact, comprising a planar rigid printed circuit board, a circular array of fixed contacts on the circuit board, and a terminal lead extending from each fixed contact to a terminal portion of the circuit board, a movable contact comprising a helical spring member mounted with its axis perpendicular to the plane of the circuit board, one end of the spring member being secured to the circuit board in electrical engagement with one of the fixed contacts, the spring member having a low spring rate at the said one end and progressively increasing in spring rate toward the other end whereby upon axial compression the spring member is progressively movable into electrical engagement with the other fixed contacts to bridge the contacts, the number of fixed contacts engaged by the movable contact depending on the degree of compression of the spring member, and an actuator secured to the other end of the spring member for support thereof and for applying a force to the spring member to compress it into engagement with the fixed contacts.

* * * * *